United States Patent [19]

Cahn et al.

[11] 4,102,741

[45] Jul. 25, 1978

[54] LOW VAPOR PRESSURE ORGANIC HEAT RETENTION MATERIALS KEPT AT ATMOSPHERIC PRESSURE USED AS HEAT STORAGE MEDIA

[75] Inventors: Robert P. Cahn, Millburn; Edward W. Nicholson, Summit, both of N.J.

[73] Assignee: Exxon Research & Engineering Co., Linden, N.J.

[21] Appl. No.: 745,007

[22] Filed: Nov. 26, 1976

Related U.S. Application Data

[63] Continuation-in-part of Ser. No. 533,263, Dec. 16, 1974, Pat. No. 3,998,695.

[51] Int. Cl.[2] ..... G21C 15/28

[52] U.S. Cl. ..... 176/87; 60/644; 60/659; 176/39

[58] Field of Search ..... 208/28, 106; 252/404; 60/644, 659; 176/39, 87

[56] References Cited

U.S. PATENT DOCUMENTS

| | | | |
|---|---|---|---|
| 2,921,017 | 1/1960 | Johnson et al. | 208/106 |
| 3,156,543 | 11/1964 | Coffield et al. | 252/404 X |
| 3,457,315 | 7/1969 | Moffatt | 252/404 X |
| 3,707,459 | 12/1972 | Mason et al. | 208/106 X |
| 3,950,949 | 4/1976 | Martin et al. | 60/676 X |

OTHER PUBLICATIONS

Hobson et al., Modern Petroleum Technology, John Wiley & Sons, N.Y., N.Y., 4th Ed., 1973, p. 286.

*Primary Examiner*—Peter A. Nelson
*Attorney, Agent, or Firm*—Joseph J. Allocca

[57] ABSTRACT

The excess power from a power station, whether nuclear, fossil fuel, geothermal, solar, etc. is stored in the form of heat in a low vapor pressure thermal energy retention material which is selected from the group consisting of petroleum hydrocarbon distillates having a boiling range of between 500° to 1300° F with a vapor pressure in the temperature range of 500°-650° F not exceeding 1 atm. Low vapor pressure thermal energy retention materials may be heated in any number of ways, for example, directly by turbine extraction steam and primary high pressure steam, or by means of excess volumes of boiler feed water heated by turbine extraction steam and primary high pressure steam, or by direct solar energy or by means of the excess electricity generated by any form of power station.

The hot LVP thermal energy retention materials are stored in hot storage location means and used during peak demand periods to supply extra power when needed either by the transfer of heat to boiler feed water, the generation of intermediate pressure steam (to run turbines) thereby effecting the conversion of stored thermal energy into additional power. After use they are kept in cold storage location means.

8 Claims, No Drawings

LOW VAPOR PRESSURE ORGANIC HEAT RETENTION MATERIALS KEPT AT ATMOSPHERIC PRESSURE USED AS HEAT STORAGE MEDIA

CROSS REFERENCE TO RELATED APPLICATIONS

This case is a continuation-in-part of Ser. No. 533,263 filed Dec. 16, 1974, now U.S. Pat. No. 3,998,695.

The typical nuclear powered electric generation plant consists of essentially two distinct sections. The heart of the plant is the nuclear reactor, the source of the heat used to generate the steam in the boiler utilized by the turbines and generators. The nuclear reactor and steam boiler represent about 75% of the total investment in nuclear powered electric generating stations and are limited in the degree of flexibility they can exhibit. The steam turbines, condensers, generators, fittings and general electrical facilities represent the remaining 25% of the total investment, are strictly conventional in design and operation and are, further, capable of operation over relatively wide variation of parameters.

There are many practical objections to throttling the output of a nuclear reactor. A reactor is most efficient when operating at maximum potential. Periodically reducing the output of the reactor reduces the efficiency, increases operating difficulties and hazards and increases the costs of running the plant. This inherent inflexibility of nuclear plants means that they can only be utilized as "base load" plants and that the intermediate load and peak-shaving service have to be met by conventional fossil fuel fired generators (coal or oil-burning boilers or gas turbines, etc.). The expensive nuclear heart of the nuclear powered generation plant is incapable of following load demands and, therefore, a large part of the total daily power requirements are not met by the nuclear plants.

The instant invention relates to low vapor pressure organic (thermal energy retention) materials which, during periods of low power demand, store the excess energy output of steady state power stations. The low vapor pressure (LVP) organic thermal energy retention materials stored at atmospheric pressure are used during peak energy demand periods as boiler feed water and interstage steam reheating materials and/or as a means of generating intermediate pressure steam for use directly in turbines. Their use allows operating a steady state nuclear reactor and boiler at maximum steady conditions while the turbines, generators and electrical facilities can fluctuate between about 65–130% or as much as 25–150% of a base load of 100%. If this 65% is considered the new base load, the nuclear plant will now have a capacity of 100% of base load to peak load following capacity and while operating continuously at maximum efficiency, the plant will be able to utilize the flexibility of the conventional electrical generation apparatus. If the 25% is considered the new base load, the load following capacity can be manifold the base load capacity.

They are also applicable to modern fossil fuel plants, particularly those based on supercritical steam cycles and those incorporating pollution abatement provisions either in the form of fuel gas preparation of flue gas scrubbing facilities. Since such facilities are very expensive, they, similar to nuclear reactors, force the utility to operate such plants all out as base load stations. Any provision to permit them to follow the load would extend the use of such plants into the intermediate and even peak shaving load ranges.

This invention offers the further advantage of rapid response to demand. The unit can follow the load by adjusting the steam rate to and from the turbine by regulating the amount of preheat and reheat done by extraction steam and the amount of BFW preheat and interstage steam reheat done by hot LVP organic thermal energy retention material moving between hot and cold storage location means and by advantageously using the ability of the stored hot LVP organic material to raise intermediate pressure steam for use directly in the turbines. Therefore, the present invention must be considered as making totally available the spinning reserve up to the maximum capacity of the turbine-generator combination.

U.S. Pat. No. 3,886,749 to Pacault, teaches a steam power station which utilizes an accumulator for storing heat drawn from the operating steam cycle during slack operating periods when power demand is down and restoring said stored heat to the system during peak operating periods. The stored heat may be returned to the system through the stratagem of preheating boiler feed water and interstage steam reheat.

Examination of this patent however, draws to attention the fact that the key heat storage apparatus is an accumulator which features a static, nonmoving heat storage material, be it refractory material or stored heat carrier liquid, which static stored material is heated by means of a flowing heat transfer fluid. The process clearly indicates that the heat transfer fluid circulates and picks up heat from the turbines and stores this heat in a large volume of nonmobile heat retention material in the accumulator.

By way of comparison, the instant invention utilizes a stored LVP heat retention material but said material is mobile, that is, moving from a hot storage location to a cold storage location. Such moving of low vapor pressure thermal energy heat retention material exhibits the distinct advantage over nonmoving heat retention material system (accumulator) in that by moving the LVP material the boiler feed water being heated is continuously being contacted with full temperature LVP material for as long as there is material stored in the high temperature tank. This means that for the entire period of peak power demand, or for as long as there is stored material in the hot tank, the BFW will contact uniformly hot material and will therefore be heated to a uniformly high temperature, i.e. the last unit of BFW heated will be heated to the same high temperature as the first unit of BFW so heated. By comparison, in a fixed bed thermal accumulator, heat can be stored by passage of a hot thermal energy carrier fluid. On flowing from one end to the other of said accumulator, the fluid will give up heat by thermal conduction to the solid tiles or particles which make up the bed, resulting in a temperature front advancing along the bed in the direction of flow. Behind this front, the temperature of the solid will be close to the temperature of the entering hot fluid. Ahead of this front, the temperature of the solid and fluid will be essentially that of the packing when the operation started. The width of the front (length of bed over which the temperature changes from hot fluid to cold packing) is a function of many parameters including heat capacities and heat transfer properties, fluid flow rate, bed and particle diameter, etc. Also, the regularity or evenness of the front is very much a function of flow distribution, channeling, flow rates, etc.

The same holds true when the bed is hot and the entering fluid is cold, except all temperature indications are reversed.

The net effect of using a fixed bed accumulator at initial temperature $T_a$ on a fluid flowing through it with initial temperature $T_b$ is that the fluid will leave the accumulator with temperature close to $T_a$ for a period of time set by the time required for the above temperature front to advance through the length of the accumulator. This time is strictly a function of the heat capacity of the flowing fluid vs. the heat capacity of the total accumulator packing.

When the front of the temperature front "breakthrough" reaches the end of the accumulator, the temperature of the fluid leaving the accumulator will slowly change from close to $T_a$ to close to $T_b$. The ratio of the length of time over which the effluent fluid is at a more or less constant temperature $T_a$ to the length of the varying temperature period is a measure of the efficiency of the solid accumulator method of storing heat. Due to slow heat transfer, poor liquid distribution and channeling and superimposed thermal convection currents, the ratio of constant/varying effluent temperature periods is not sufficiently high to make this a preferred method of storing heat.

Other disadvantages of storing heat in a solid accumulator is expansion and contraction of the solid resulting in stresses and breakage, formation of fines which foul exchangers and the high cost of such devices. The specific heat of solids is usually much lower than that of liquids, resulting in a large weight and physical volume (allowing for voids) and corresponding interstitially held up liquid in these large containers.

The inefficiency of solid accumulators to store heat rather than storing the heat transfer fluid in two tanks (which means that the cold fluid is always cold and the hot fluid always hot) is therefore: (a) the need for one additional heat transfer in and out of the solid, with the resultant 2 $\Delta T$ losses; (b) the inefficiences of channeling, convection currents, slow heat exchange, etc. which result in broad temperature fronts, i.e. variable temperature hot and cold streams for a good part of the cycle. These variable temperature streams are not desirable for normal plant operation.

U.S. Pat. No. 3,818,697 to Gilli discloses a complex arrangement of high pressure steam/water accumulators which are reduced in pressure and temperature by flashing, thereby generating turbine steam at different and varying pressures. The hot water is allowed to flash, the steam produced is used in a turbine and the condensate is returned to the accumulator, thereby reducing the temperature of all the material stored in said accumulator.

The patent also describes the use of a superheater, an accumulator which stores a hot material such as oil, diphenyl or terphenyl. These accumulators would function at low pressure. The stored "oil" would be permitted to flow in a closed system and is used only to superheat the steam generated by flashing of the stored high pressure water previously described. This patent, however, utilizes a closed loop whereby the oil would heat the steam and then, in a cooled state by returned to the acumulator vessel thus lowering the temperature of the entire volume of stores hot oil as the operation progresses.

By comparison, the instant invention stores hot lower vapor pressure organic heat retention material ("oil" for short) in isolation from the cold "oil". The hot material is never degraded by mixing with expended "cold" material. Furthermore, the instant invention utilizes its stored heat to preheat boiler feed water and/or reheat interstage steam and/or generate steam to be fed into the turbines. The instant application discloses storing hot "oil" during periods of low power demand and recalling the heat so stored during periods of peak power demand by moving the hot material from a hot storage means to a cold storage means, with the hot material in the meantime producing hot BFW or reheating interstage steam or generating interstage power steam. Furthermore, since the hot and cold "oil" are not mixed during the course of use, the "hot" material retains its temperature until all of the material is utilized. Thermal degradation does not occur.

Littler, D. J. Unipede Report on "Electrical Energy Storage", IERE Meeting, Tokyo, May 14–19, 1975 describes numerous energy storage schemes, the one of primary interest in this instance being heat storage in the form of hot water, preferably flashed to steam rather than steam storage. In two variations on the main theme of heat storage, Littler describes storage of hot water, which will be used during peak demand periods as boiler feed water and as variation No. 2 the flashing of stored pressurized hot water to generate steam for use in auxiliary turbines. Littler states that a variant of hot water storage is to store a secondary fluid rather than water, but does not describe any embodiment, nor does he indicate if any embodiment indeed exists, other than for the off-handed aside. As presented and lacking further clarification, this falls into the category of Gilli and cannot be read as disclosing the concept of the instant invention.

In Ser. No. 533,263 filed Nov. 11, 1974, in the names of Cahn and Nicholson, it is disclosed that thermal energy can be stored in a LVP (low vapor pressure) organic material by transfer of heat directly from extraction steam and/or primary high pressure steam to the LVP organic material. The hot LVP organic material is stored in a high temperature storage location means. Maximum LVP organic material heating occurs at night or during periods of low power demand while during peak demand periods, BFW preheat and interstage steam reheat chores are done by moving the hot organic material from the high temperature storage means to a low temperature storage means in the process contacting boiler feed water with the hot LVP organic heat retention material at heat exchanger means, so that extraction steam withdrawal and withdrawal of primary high pressure steam can be reduced or terminated. Hydrocarbon oils with good heat transfer properites are excellent for temperature below about 650° F if kept isolated from the atmosphere to prevent oxidation. Such materials as heavy hydrocarbon oils will have a satisfactory low vapor pressure (i.e. one less than 1 atm.) at the maximum usable temperature. Thermal energy up to about 600°–650° F can consequently be stored in such hydrocarbon oils.

The invention of U.S. Ser. No. 613,754 to Cahn, herein incorporated, simplifies the above concept and reduces the dangers present when high pressure steam and extraction steam are used to heat an LVP organic material within the confines of the power plant and when such hot LVP organic material is stored in the vicinity of the power house. It also eliminates the problems which are faced when steam is used to heat an LVP organic material at any distance from the power house, such problems being multiplicity of steam and condensate lines, steam line designs, wet steam metering, pressure drop and quality control problems.

It overcomes these difficulties and allows a reasonably distant oil storage site to operate very effectively in conjunction with a utility powerhouse. This advantage is achieved by using hot water, that is, a portion of the hot boiler feed water stream itself, as reheating medium for the LVP organic material.

Water from the condensers is fed to BFW heating means which heating means utilize extraction steam from the turbines. These heating means are sized roughly twice as large as in plants without the LVP organic material heat retention systems. At night, or during periods of low power demand, such heating means units can preheat about twice the normal amount of BFW using about twice the normal amount of high pressure and extraction steam. The normal amount of BFW is fed to the boiler while the additional hot water is sent to water-oil heat exchanger means whereat the LVP organic material moving from cold storage location means to high storage location means, is reheated. The BFW lines designed to handle double the amount of BFW can be either two independent lines or one large high pressure line. The "cold" water (~210° F) from the LVP organic material reheat exchanger means is returned to the BFW reheat line where it joins cold condensate for reheating through the steam-waterheating means or alternatively the expended BFW which has been used to preheat LVP organic material (now at a temperature of about 210° F) is stored in separate storage means for use as BFW during peak demand periods.

In a variation on the above concept, the hot boiler feed water used to heat the LVP organic material may be drawn from the BFW line at locations of varying temperature and pressure, sent by transporting means, for example, a conduit, to heat exchanger means whereat the LVP organic material moving from a low temperature storage location means to a high temperature storage location means, picks up thermal energy and the now partially cooled water is returned by another transporting means to the BFW line at a point of lower temperature and pressure than the point at which said stream was drawn off.

During peak demand periods, BFW preheating in the steam-water heating means may be essentially terminated. However, it may actually be advantageous to continue withdrawing extraction steam out of the turbine at the lowest pressure extraction stages in order to heat the cold condensate (i.e. Boiler feed water) somewhat, even during peak periods.

The amount of power which can be effectively stored at the low temperature levels of this low pressure steam, in the range of 130°–175° F is very small, while the exchanger means required to achieve good temperature transfer and useful heat levels with materials which have high viscosity when cold are high. Cold BFW (or BFW from a 210° F storage means) is heated through contacting with hot LVP organic material, which is moving from high temperature storage location means to low temperature storage location means. Such heating is performed either in separate exchanger means or preferably in the same exchanger means wherein cold LVP organic material moving from cold to hot storage means was initially heated by hot BFW, the heating of the BFW being done simply by reversing the flows of the water and LVP organic material. The exchanger means function as both oil heater means- water cooler means (during off hours) and oil cooler means- water heater means (during peak demand).

Preheated BFW is taken from the last water heater means and sent to the boiler. For the system to work efficiently, it is necessary that extra large steam-water heating means be available since effectively twice the quantity of BFW is produced during off-hours.

This system has the advantage over other systems in that a limited number of interconnection means exist between the power plant and the storage plant and all connections are water transporting means (i.e. lines). Further, the number and type of heat exchanger means are simplified from units which can alternate between steam-oil and water-oil service to units only performing water-oil service and this alteration of the exchanger means type is what facilitates exchanger means simplification since now heater function can be changed merely by reversing material flow. Furthermore, since water is easier to transmit over a distance than wet steam, such an energy storage facility can now be located at a distance from the powerhouse, and it is possible that such a facility can be shared by a number of power plants, thereby resulting in substantial savings over individual in-plant energy storage facilities.

As previously mentioned, it is also possible to utilize stored hot water as BFW. This hot water at 210° F can be either the water used to initially heat the LVP organic material or it can be water specifically heated by low pressure extraction steam and stored for eventual use. This hot water stored at atmospheric pressure is used as BFW and fed either by itself or mixed with cold condensate to the hot LVP organic material heat exchanger means for heating to optimum BFW temperature. By using stored hot water at about 210° F, it is possible to reduce the amount of heat exchanger means heating area required to achieve a given BFW temperature. Such savings, however, are obtained at the cost of providing hot and cold water storage means. The advantage, however, is achieved by reduced and simpler exchanger designs and oil handling requirements.

The fraction of the power output of a thermal generating station which can be stored in a heat storage medium is very much a function of the temperature level at which the heat is stored and at which it is subsequently utilized in the power generating thermodynamic cycle. The level at which it is used in the thermodynamic cycle must always be somewhat lower than the temperature at which it is stored, which in turn is somewhat lower than the temperature level at which it is drawn out of the primary cycle during off-peak periods (i.e. during the heat storage cycle). The higher the utlimate utilization temperature level, the greater the fraction of the power output which can be stored, and also the higher is the storage efficiency, assuming a given original temperature level at which that increment of heat was drawn out of the primary cycle.

For example, 1000 lb/hr of steam at 1000 psia and 545° F or so can generate about 75 KW in a modern nuclear power plant. The same quantity of steam at 160 psia and 365° F only generates 35–45 KW of power. While the quantity of heat stored is roughly the same, the achievable power output is less. Therefore, it is desirable to store as much high level heat as possible, and to use it at as high a temperature level as possible. Heat which is stored at 500°–550° F should be used at that level and not degraded to 350°-400° F heat by injecting it into the power plant cycle, as this will lose 40% or so of the recoverable power.

At the same time, it is desirable to maximize the temperature range between the hot oil and the "cold" oil, i.e., to maximize the energy which is stored and recoverable per unit volume of LVP organic material. Therefore, it would not be economical to store and use heat just at the 500°-550° F level and not utilize the potentially recoverable energy in the 200°-500° F temperature range in the stored oil. Conversely, if BFW preheat requirements for a certain powerhouse cycle only require temperature levels of 200°-450° F for the stored LVP organic material, since BFW temperature is limited to say, 420° F, there is a real incentive to extend the temperature range of the stored LVP material upwards into the range of 500°-600° F and to use it at that level in the powerhouse cycle so as to extend and increase the amount of heating which may be done and to increase the fraction of the powerhouse capacity which can be stored in the LVP material.

As previously explained, using this 450°-550° F or 450°-600° F heat to assist in the BFW preheat to the 420° F level is feasible but not very desirable in view of the efficiency loss. Generating some medium pressure steam with this heat is possible, but will result in some efficiency loss due to the high latent heat requirements of steam generation. However, this alternate is an attractive alternate if maximizing the fraction of power to be stored is a goal at the expense of efficiency.

In a particularly attractive alternate embodiment, BFW is heated during low power demand periods to super hot temperatures, well in excess of boiler requirements. Some, as previously described is sent to LVP organic material heater means to heat the LVP organic material. The other fraction is used to reheat interstage steam, thereby being cooled sufficiently to function as BFW. During peak demand periods, BFW preheat chores are carried out using hot LVP organic material moving from high temperature storage means to low temperature storage means. The BFW either directly from the condenser or from hot water storage means or both, is heated to super high temperatures by the moving LVP organic material at oil-water-heat exchanger means. This superheated BFW is first used to reheat interstage steam and then used in its cooled state as boiler feed water. Such a scheme maximizes the energy storage in the LVP organic material, and enables boilers using feed water at about 420° F to take advantage of the BFW high temperature attainable with hot LVP organic material without wasting that portion storable between about 440° F to 520°-550° F. The cooling necessary to utilize 500°-550° F BFW in a 420° F BFW preheat boiler is achieved by sending the hot BFW stream through the interstage steam reheater means exactly as was done with 500°-550° F BFW from the high pressure steam and extraction steam heater means during off peak hours when heating is done not by moving hot LVP organic material but by extraction and primary high pressure steam.

It is clear that the LVP organic material may be heated during off-peak hours by any number of methods. Thus, this heating of the LVP organic material can be done via the hot water loop-method disclosed herein or via the direct high pressure and extraction steam heating of copending Ser. No. 533,263, or any other means and the hot LVP organic material so obtained can be stored in a high temperature storage means for use during peak demand periods to preheat boiler feed water and/or to generate super hot boiler feed water and use such super hot water to reheat interstage steam before being used in a cooled state as BFW.

In the practice of the storage of the excess power of power stations in the form of heat, the heat storage medium is described as a low vapor pressure organic heat retention medium. Such an LVP is a hydrocarbon oil, preferably derived from petroleum by distillation and refined, if necessary, by catalytic treatment for the hydrogenation of unsaturates and/or for the removal of sulfur (and nitrogen) in the presence of hydrogen under pressure utilizing any of the standard catalysts known in the art such as cobalt molybdate, nickel-molybdenum, etc. The hydrocarbon distillate can also be treated by means of solvent extraction to remove unstable, easily oxidized compound which could lead to sludge and deposit formations on hot heat exchanger means surfaces. The material can also be dewaxed by use of the appropriate low-temperature crystallization/separation techniques known in the art to improve the low temperature handleability (i.e. viscosity and fluidity) of the oil. Before being treated as described above, the hydrocarbon distillate can be thermally and/or catalytically cracked to remove any thermally unstable material persent but such cracking should be followed by hydrogenation to remove any unsaturation resulting from the cracking.

The hydrocarbon distillate used should be the fraction within the boiling range of 500 to 1300° F, preferably 600 to 1100° F and most preferably 650 to 1000° F. The vapor pressure of the material used for such thermal energy storage should not exceed 1 atm at the maximum utilized storage temperature, say 500°-650° F and should preferably be below 0.25 atm and most preferably, below 0.1 atm. This is preferred since low vapor pressures facilitate the use of unpressurized storage means and storage systems which do not require special high pressure construction are naturally more economical, durable and more easily maintained. Such materials of low vapor pressure may be kept in isolation from the atmosphere, so as to avoid material degradation, by means of an inert gas atmosphere blanketing the stored material, and may include the use of an insulated floating roof or diaphragm-type apparatus over the stored material. The higher the vapor pressure, or even the closer the pressure gets to 1 atm. problems arise in systems isolation and materials handling. Inert gas transfer and balance between hot and cold storage means becomes a problem when the organic material has a vapor pressure approaching or exceeding 1 atm at the storage temperature.

Typical materials which qualify as low vapor pressure organic heat retention materials are exemplified but cannot be viewed as exhaustively disclosed by the following:

Vacuum gas oil obtained from crude 650° F VT atmosphere pipestill bottoms by running in a vacuum pipestill, getting a 650°/1050° F VT cut, followed by hydrodesulfurization over a catalyst in the presence of $H_2$ under pressure;

The vacuum gas oil described above further treated by solvent extraction to remove unsaturates, sulfur and nitrogen compounds and aromatics;

Catalytic cracking cycle stock with a boiling range of from about 600° to 950° F drawn from a recycle catalytic cracker followed by hydrotreating. The feed to the catalytic cracker, which is usually a material with a boiling range of from 500° to 900° F, may but does not necessarily have to have been hydrotreated for sulfur removal prior to cracking;

Thermally cracked gas oil, i.e. steam cracked gas oil in the 600° to 1000° F boiling range after appropriate catalytic hydrotreating to saturate olefins and diolefins and to decrease sulfur and nitrogen content;

600° to 900° FVT fraction obtained from hydrocracking, a process in which heavy gas oils are catalytically broken down and hydrogenated over a catalyst in one or more steps;

600° to 900° FVT coker gas oil suitably stabilized by catalytic hydrogenation.

The sulfur levels in the feeds considered may range, prior to hydrogen treatment, from 0.3 to 5.0% and should be of the order of 0.05 to 1% following hydrogenation.

Oxidation stability additives and sludge dispersants and depressants may be added to the product to improve its performance in the hot LVP thermal energy retention material (i.e. oil) storage plants. Typical antioxidants are hindered phenols, such a t-butyl phenol and typical dispersants may be sulfonates or ashless dispersants based adducts. The content of the anti-oxidants and dispersants in the oil would preferably be below 1% each

What is claimed is:

1. In a process for the storage of the excess energy output of a power plant in the form of heat in a low vapor pressure thermal energy retention material, kept at atmospheric pressure, using as the low vapor pressure (LVP) thermal energy retention material a petroleum hydrocarbon distillate having a boiling range of between 500° to 1300° F with a vapor pressure in the temperature range of 500°-650° F not exceeding 1 atm., wherein the hydrocarbon distillate used as the LVP thermal energy retention material is selected from the group consisting of 650° to 1050° vacuum pipestill cut, a 600° to 950° F catalytic cracking cycle stock, a 600° to 1000° F thermally cracked gas oil, a 600° to 900° F hydrocracking cut, and a 600° to 900° F coker gas oil.

2. The process of claim 1 wherein the hydrocarbon distillate used as the LVP thermal energy retention material is treated with hydrogen in the presence of a catalyst.

3. The process of claim 2 wherein the hydrocarbon distillate used as the LVP thermal energy retention material has sulfur levels prior to hydrogen treatment ranging from 0.3 to 5.0%.

4. The process of claim 2 wherein the hydrocarbon distillate used as the LVP thermal energy retention material is further characterized by having present therein additives selected from the group consisting of oxidation stability additives, sludge dispersants and depressants and mixtures thereof.

5. The process of claim 4 wherein the additive containing hydrocarbon distillate used as the LVP thermal energy retention material contains less than 1% of each additive.

6. The process of claim 4 wherein the hydrocarbon distillate used as the LVP thermal energy retention material having additives therein contains hindered phenols as the antioxidant additives and sulfonates as the dispersants.

7. The process of claim 2 wherein the vacuum pipestill cut is a vacuum gas oil which is further treated by solvent extraction.

8. The process of claim 1, wherein said power plant is selected from the group consisting of nuclear, fossil fuel, geothermal, and solar power plants.

* * * * *